US006151470A

United States Patent [19]

Park

[11] Patent Number: 6,151,470

[45] Date of Patent: Nov. 21, 2000

[54] APPARATUS FOR ELEVATING SQUEEGEE ROLLER AND DEVELOPMENT ROLLER FOR LIQUID PRINTER

[75] Inventor: Woo-yong Park, Suwon, Rep. of Korea

[73] Assignee: Samsung Electronics Co., Ltd., Kyungki-do, Rep. of Korea

[21] Appl. No.: 09/434,101

[22] Filed: Nov. 5, 1999

[30] Foreign Application Priority Data

Nov. 6, 1998 [KR] Rep. of Korea ..... 98-47537

[51] Int. Cl.[7] ..... G03G 15/10

[52] U.S. Cl. ..... 399/249; 399/237

[58] Field of Search ..... 399/75, 249, 237, 399/348; 430/117

[56] References Cited

U.S. PATENT DOCUMENTS

| | | | |
|---|---|---|---|
| 5,987,285 | 11/1999 | Kusayanagi | 399/249 |
| 6,035,167 | 3/2000 | Sekura | 399/249 |
| 6,041,206 | 3/2000 | Park | 399/249 |
| 6,049,684 | 4/2000 | Nishikawa et al. | 399/249 |

*Primary Examiner*—Sophia S. Chen

*Attorney, Agent, or Firm*—Sughrue, Mion, Zinn, Macpeak & Seas, PLLC

[57] ABSTRACT

An apparatus for elevating a squeegee roller and a development roller for a liquid printer, including a pair of first supporting blocks for rotatably supporting both ends of the development roller which transfers a developer liquid to the transfer surface of a photoreceptor belt, a pair of second supporting blocks for rotatably supporting both ends of the squeegee roller which compresses the transfer surface of the photoreceptor belt and removes liquid carrier contained in the transferred developer liquid, a pair of cases in which the first and second supporting blocks are elevatably accommodated parallel to each other, a first elevating mechanism for elevating the cases relative to the photoreceptor belt, a driver unit for driving the first elevating mechanism, and a second elevating mechanism for elevating the first and second supporting blocks in sequence with the elevation of the cases. The apparatus elevates and adjusts the rollers according to the operation mode of the printer.

13 Claims, 8 Drawing Sheets

APPARATUS FOR ELEVATING SQUEEGEE ROLLER AND DEVELOPMENT ROLLER FOR LIQUID PRINTER

BACKGROUND OF THE INVENTION

1. Field of the Invention

The present invention relates to a liquid printer, and more particularly, to an apparatus for elevating a squeegee roller and a development roller, for adjusting their setting positions relative to a photosensitive medium by adaptively elevating the squeegee roller and the development roller according to the operation mode of the printer.

2. Description of the Related Art

As shown in FIG. 1, a liquid printer such as a color laser printer includes a development device for supplying a developer liquid to an electrostatic latent image formed on a transfer surface 10a of a photoreceptor belt 10 as a photosensitive medium.

The development device includes a development roller 11 for transferring a developer liquid supplied from a developer liquid spray nozzle 15 to the transfer surface 10*a* of the photoreceptor belt 10. A backup roller 14 is positioned opposite development roller 11. In the downstream side of the development roller 11, there is a squeegee roller 12 for removing a carrier contained in the developer liquid transferred on the transfer surface 10*a* of the photoreceptor belt 10 by pressing the photoreceptor belt 10 toward a backup roller 13.

As the printing operation is repeatedly carried out, the developer liquid may accumulate and coagulate on a contact portion of the photoreceptor belt 10 and the squeegee roller 12, thereby forming a drip line (D).

Thus, in order to obtain a clean-quality printed image, it is necessary to remove the drip line D at regular time intervals during the printing operation. The drip line D is removed in a drip line removal mode in which the squeegee roller 12 is driven in a reverse direction to the rotating direction thereof in a printing mode.

In the drip line removal mode, in order to reduce a rotation load due to the reverse rotation of the squeegee roller 12, the squeegee roller 12 is lowered by an elevating apparatus shown in FIG. 2. Then, the squeegee roller 12 presses the photoreceptor belt 10 at a lower level position than in the printing mode, thereby decreasing the compressive force. After the printing operation is terminated, the elevating apparatus lowers both the squeegee roller 12 and the development roller 11, so that they are completely detached from the photoreceptor belt 10. In other words, the elevating apparatus elevates the development roller 11 and the squeegee roller 12 adaptively according to the operation mode of the printer, thereby adjusting their setting positions relative to the photoreceptor belt 10.

Referring to FIG. 2 showing the apparatus for elevating a development roller and a squeegee roller, which is installed in the conventional development device, a pair of sub-blocks 21 and 22 are installed to be elastically biased by compression springs 24 installed on the bottom of a main block 20. A slider 23 which linearly reciprocates is installed in the main block 20. A development roller 11 and a squeegee roller 12 are rotatably installed at the top ends of the sub-blocks 21 and 22, respectively.

The slider 23 it is elastically biased in one direction by a torsion spring 26 installed at one end thereof and linearly reciprocates by the operation of a cam 25 connected to a driver (not shown) installed at the other end thereof. Also, cam slots 23*a* and 23*b* having different shapes from each other are formed at locations substantially corresponding to those of the sub-blocks 21 and 22. Cam studs 22*a* and 22*b* protruding on the respective sub-blocks 21 and 22 are inserted into the cam slots 23*a* and 23*b*.

According to the elevating apparatus having the aforementioned construction, as the slider 23 moves to the left and right, the cam studs 22*a* and 22*b* of the sub-blocks 21 and 22 are guided by the cam slots 23*a* and 23*b* thereby elevating the sub-blocks 21 and 22 by the elastic action of the torsion spring 26 and the compression spring 24. Accordingly, the sub-blocks 21 and 22, and the development roller 11 and the squeegee roller 12 respectively installed on the top ends thereof, elevate in engagement with each other.

According to the above-described conventional elevating apparatus, it is difficult to make the overall printer system more compact, due to the space required for linear reciprocation of the slider 23.

SUMMARY OF THE INVENTION

To solve the above problems, it is an object of the present invention to provide an apparatus for elevating a squeegee roller and a development roller for a liquid printer, which can make the overall printer system compact, by elevating the squeegee roller and the development roller adaptively according to the operation mode of the printer using a cam mechanism.

Accordingly, to achieve the above object, there is provided an apparatus for elevating a squeegee roller and a development roller for a liquid printer, including a pair of first supporting blocks for rotatably supporting both ends of the development roller for transferring a developer liquid to the transfer surface of a photoreceptor belt, a pair of second supporting blocks for rotatably supporting both ends of the squeegee roller for compressing the transfer surface of the photoreceptor belt and removing liquid carrier contained in the transferred developer liquid, a pair of cases in which the first and second supporting blocks are elevatably accommodated parallel to each other, a first elevating means for elevating the cases relative to the photoreceptor belt, a driver unit for driving the first elevating means, and a second elevating means for elevating the first and second supporting blocks in sequence with the elevation of the cases.

The driver unit includes a driving source for driving a rotation supporting shaft rotatably coupled to the central axis cavity of a development backup roller installed to correspond to the development roller with the photoreceptor belt interposed therebetween, and a rotation shaft whose one end is coupled to the housing of the printer so that a first gear installed at one end of the rotation supporting shaft of the development backup roller and a second gear in engagement with the first gear are rotatably coupled to each other.

Also, the first elevating means includes a cam member rotatably coupled to the rotation shaft in parallel with the second gear, and a first cam follower member installed in the cases to perform cam driving along the curved surface of the cam member when the cam member rotates.

The second elevating means includes one or more elastic bodies interposed to be elastically biased between the case and the first supporting block an between the case and the second supporting block, and a second cam follower member installed in the first supporting block to be acted upon by the cam member.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
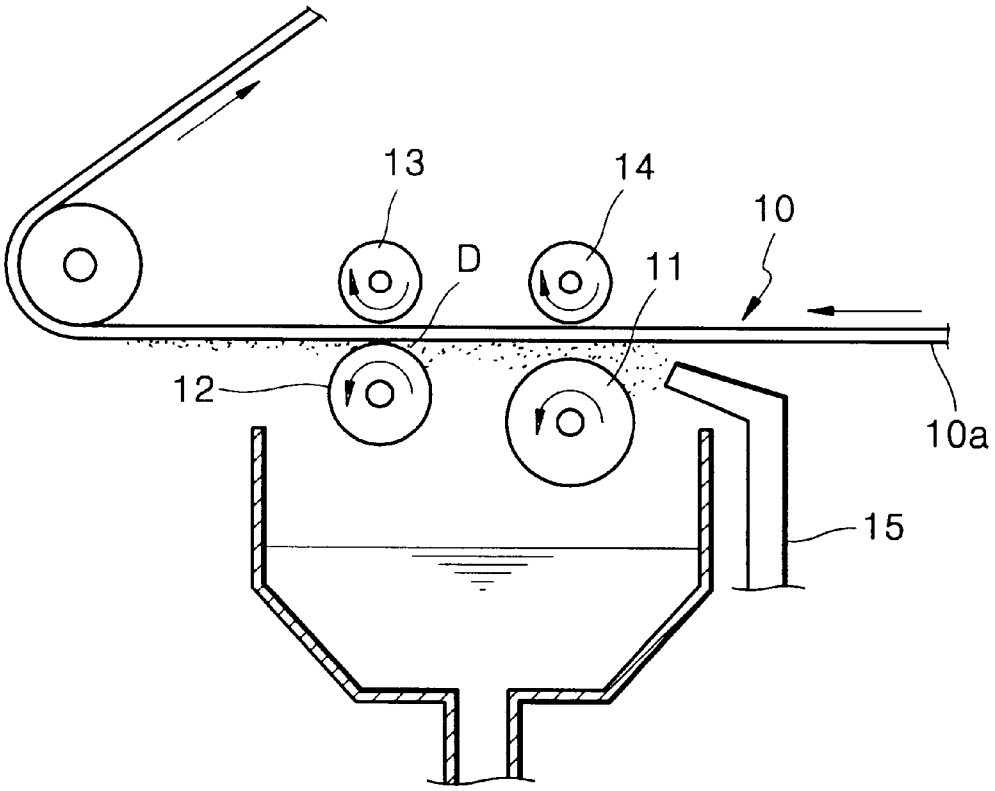
FIG. 1 (PRIOR ART)
FIG. 1 is a schematic diagram illustrating a development device of a conventional liquid printer.
Figure 2:
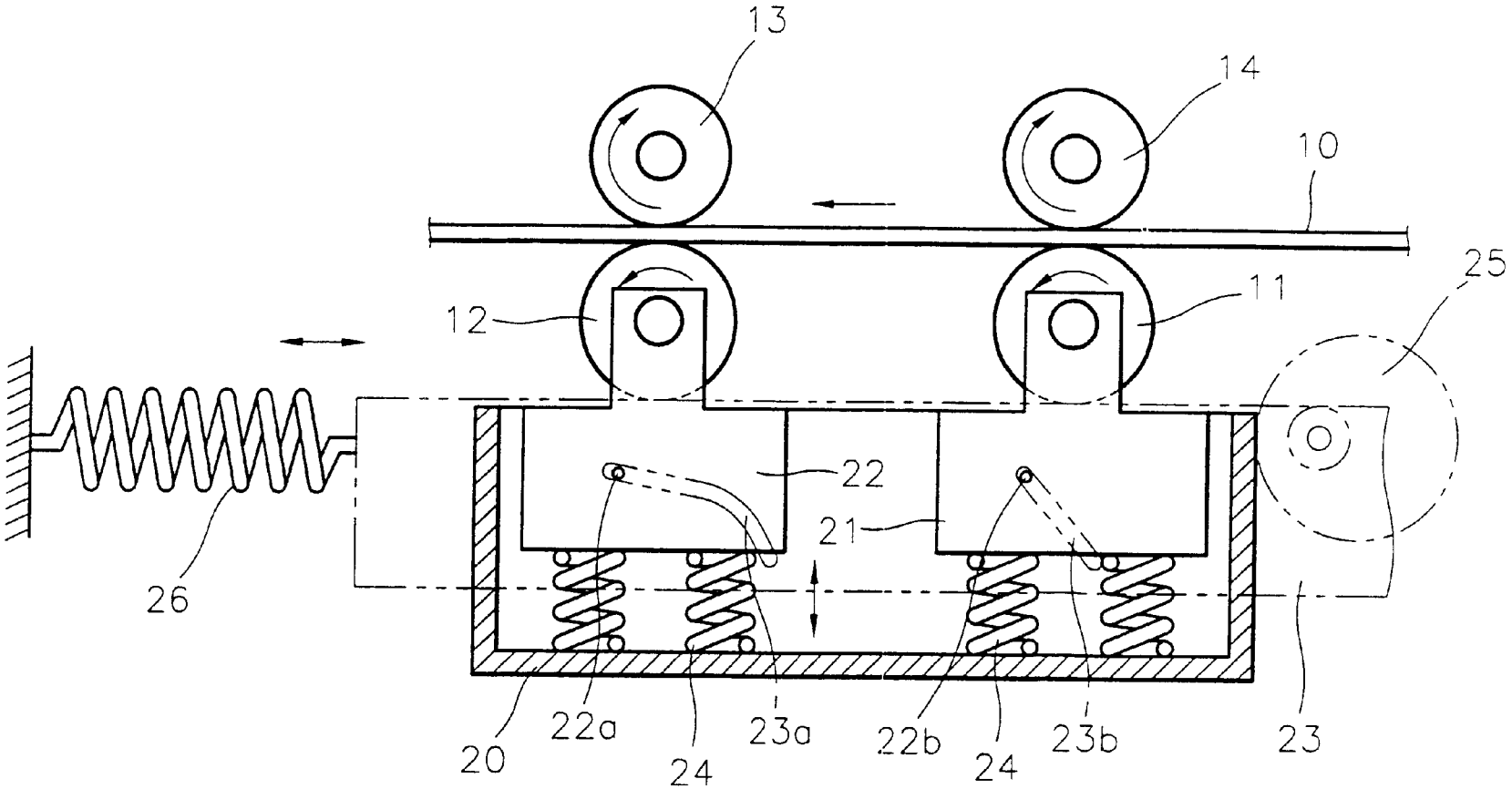
FIG. 2 (PRIOR ART)
FIG. 2 is a schematic diagram illustrating an apparatus for elevating a squeegee roller and a development roller for a conventional liquid printer.
Figure 3:
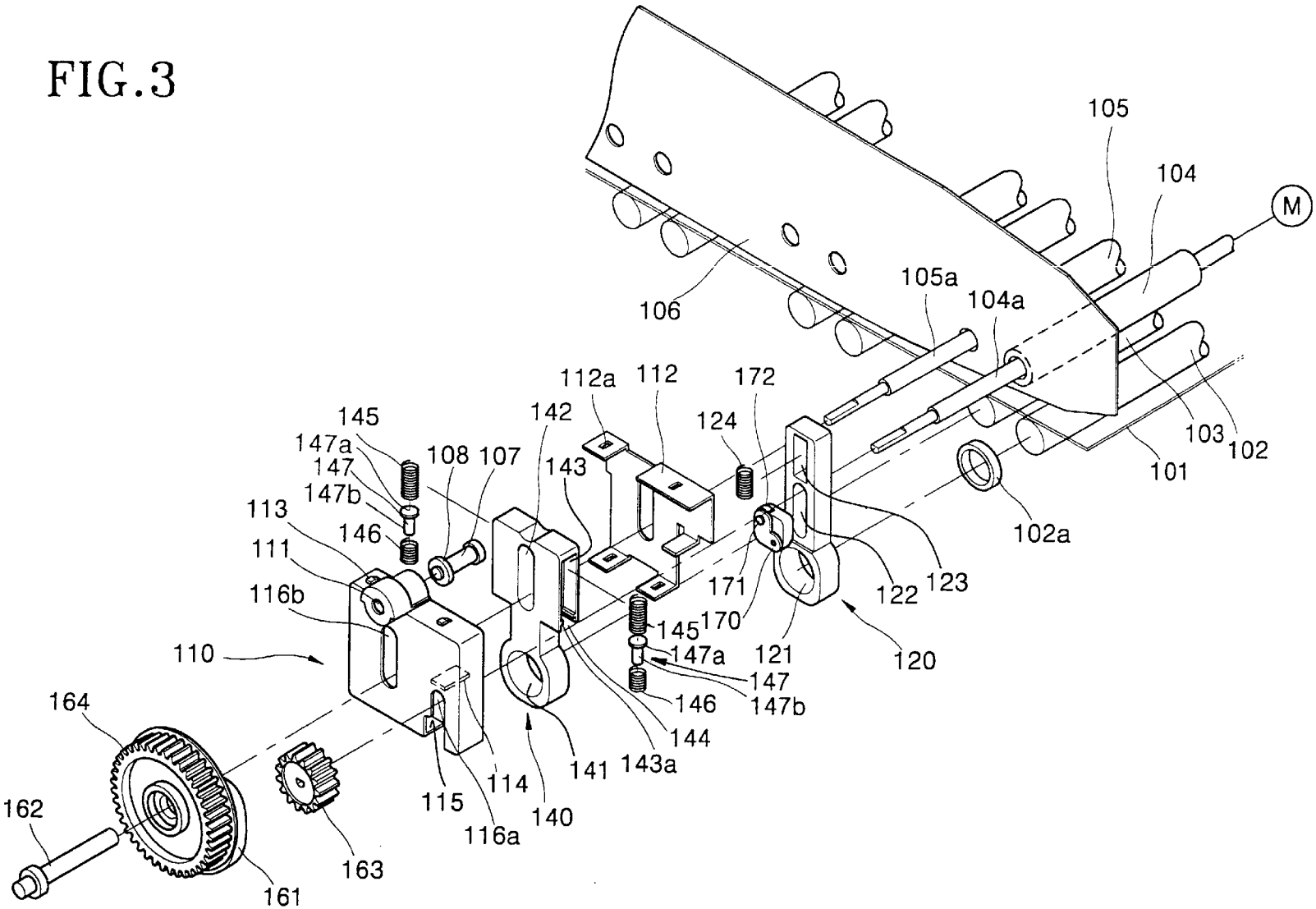
FIG. 3 is an exploded perspective view schematically illustrating an apparatus for elevating a squeegee roller and a development roller for a liquid printer according to the present invention.

Referring to FIG. 3, an apparatus for elevating a squeegee roller and a development roller for a liquid printer according to the present invention includes a first block 120 and a second block 140 for supporting one side ends of a development roller 102 and a squeegee roller 103 installed in parallel in the downstream side of a transfer surface of a photoreceptor belt 101, and a case 110 for accommodating the upper portions of the first and second blocks 120 and 140, with the lower portions thereof being exposed.

In the apparatus for elevating a squeegee roller and a development roller for a liquid printer according to the present invention, although not shown, the case 110, the first block 120 and the second block 140 are installed at the other side ends of the development roller 102 and the squeegee roller 103 in the same manner as at one side ends thereof.

Therefore, among parts provided at both sides of the development roller 102 and the squeegee roller 103, only the parts provided at one side will be explained, and a detailed explanation of the corresponding parts provided at the other side thereof will be omitted.

A cover 112 capable of being opened or closed is coupled to the case 110, and the opening or closing of the cover 112 is done by the complementary action of a plurality of protrusions 113 provided on the outer surface the body of the case 110 and a plurality of openings 112*a* provided on the cover 112.

The first block 120 and the second block 140 have substantially circular throughholes 121 and 141 to which one side ends of the development roller 102 and squeegee roller 103 are rotatably coupled at their lower portions, respectively. Elliptical Slots 122 and 142 are formed in the upper portions of first block 120 and second block 140 above the throughholes 121 and 141, respectively. A supporting shaft 104*a* of a development backup roller 104 and a supporting shaft 105*a* of a squeegee backup roller 105 penetrate elliptical slots 122 and 142 so as to be moveable up and down, and are installed to correspond to the development roller 102 and the squeegee roller 103, respectively. Here, reference numeral 102*a*; represents a gap ring coupled to a shaft end of the development roller 102. The gap ring 102*a* is installed to be displaced from the end of the photoreceptor belt 101 to contact the development backup roller 104, thereby forming a small gap between the transfer surface of the photoreceptor belt 101 and the development roller 102 during a printing mode.

The first block 120 has a rectangular insertion groove 123 above the slot 122. A protrusion piece 114 inwardly protruding in the case 110 (see FIG. 4) and a first spring 124 placed on the protrusion piece 114 are inserted into the insertion groove 123.

The second block 140 has a pair of second springs 145 and first and second lead-in grooves 143 and 144 for accommodating a pair of pin members 147 and a pair of third springs 146, in the vicinity of the slot 142.

The pair of second springs 145, and the pairs of pin members 147 and third springs 146 are disposed at opposite sides of the slot 142 to then be sequentially accommodated in the first and second lead-in grooves 143 and 144, respectively.

The pair of pin members 147 have their heads 147*a* locked by a hooking lock 143*a* formed between the first and second lead-in grooves 143 and 144 so that their legs 147*b* are positioned at the second lead-in groove 144.

The pair of second springs 145 are placed on the heads 147*a* of the pin members 147 to then be accommodated in the first lead-in groove 143.

Also, the pair of third springs 146 are placed on the pair of protrusions 115 protruding toward the inside of the case 110 to then be accommodated in the second lead-in groove 144 into which the legs 147*b* of the pin members 147 are inserted.

When the case 110 is coupled to the first block 120 and the second block 140, the lower portions of the first block 120 and the second block 140 in which the throughholes 121 and 141 are provided are exposed to the bottom, and the upper portions thereof in which the slots 122 and 142 are provided are covered by the case 110.

The supporting shaft 104*a* of the development backup roller 104 penetrates the central-axis cavity of the development backup roller 104 so that its one end is led to a driver M and its other end is led through a side wall 106 to a first coupling groove 116*a* to which a first gear 163 is rotatably coupled.

Figure 4:
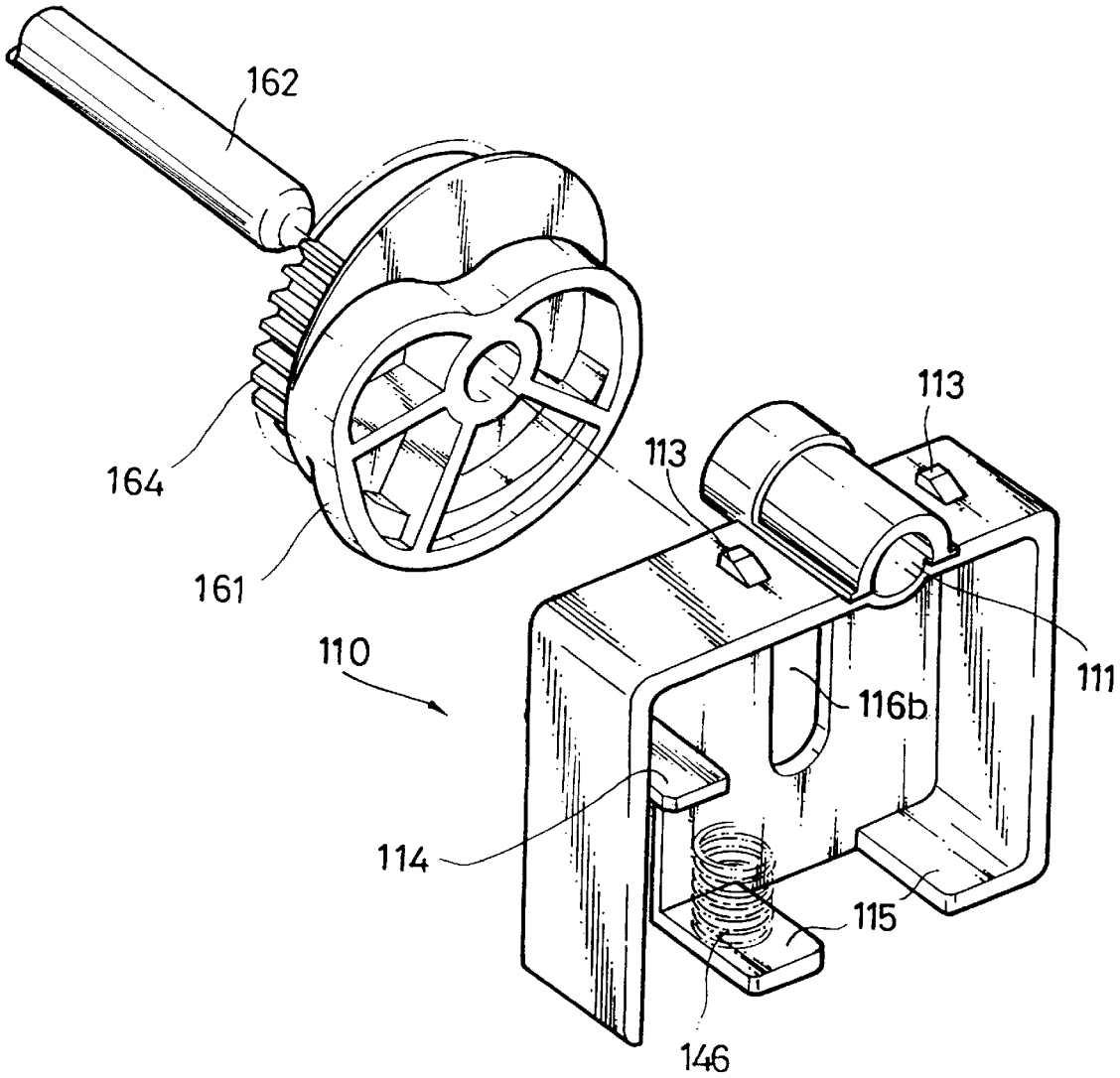
FIG. 4 is an extracted perspective view schematically illustrating essential parts of the apparatus for elevating a squeegee roller and a development roller for a liquid printer according to the present invention.

The first gear 163 is engaged with a second gear 164 rotatably coupled to the outside of the case 110. A cam member 161 is coaxially coupled to a rotation shaft 162 of the second gear 164, as shown in FIG. 4.

One end of the rotation shaft 162 is fixed on a printer housing (not shown) and the other end thereof is movably inserted into the second coupling groove 116*b* formed in the case 110. A second coupling groove 116*b* of the case 110 is an elliptical throughhole having the same shape as that of the slot 142 of the second block 140 and formed at a location corresponding to that of the same.

A shaft hole 111, to which one end of a rotation supporting shaft 107 is protrusively coupled is provided above the second coupling groove 116*b* of the case 110. A first bearing 108, as a first cam follower member contacting the cam member 161, is rotatably installed at the protruding end of the rotation supporting shaft 107.

Reference numeral 172 represents a second bearing as a second cam follower member contacting the cam member 161. The second bearing 172 is rotatably coupled to a supporting shaft 171 installed so that its one end protrudes to a cam protrusion 170 coupled around the throughholes 121 of the first block 120. The cam protrusion 170 is installed so as to protrude through the first coupling groove 116*a* of the case 110 so that the cam member 161 can contact the second bearing 172.

The apparatus for elevating a squeegee roller and a development roller for a liquid printer according to the present invention operates as follows.

Figure 5:
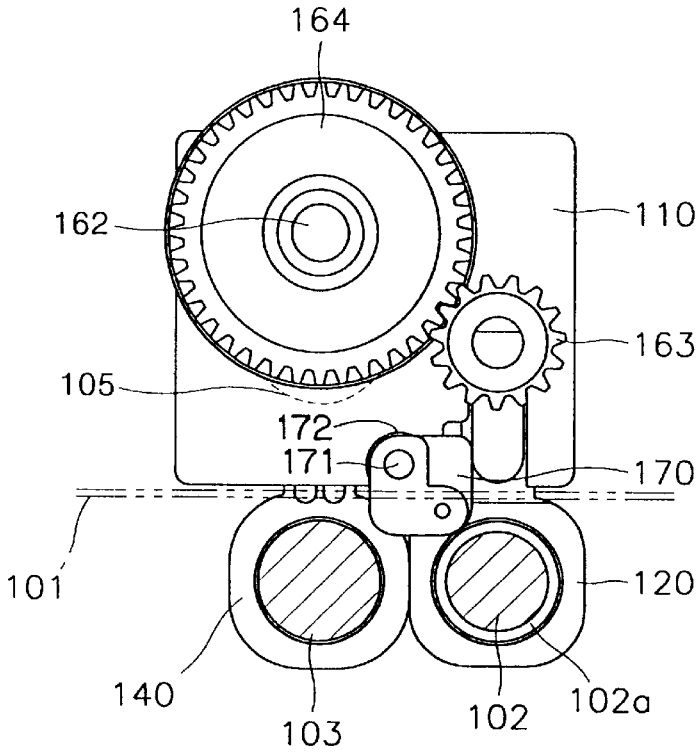
FIGS. 5 and 6 illustrate the operation state of the apparatus for elevating a squeegee roller and a development roller for a liquid printer according to the present invention a pausing mode.

Referring to FIG. 5 showing the operation state of the elevating apparatus in a pausing mode, a development backup roller 104 and a squeegee backup roller 105 press the top surface of a photoreceptor belt 101, and a development roller 102 and a squeegee roller 103 are spaced apart predetermined distances from the photosensitive plane of the photoreceptor belt 101, respectively.

Figure 6:
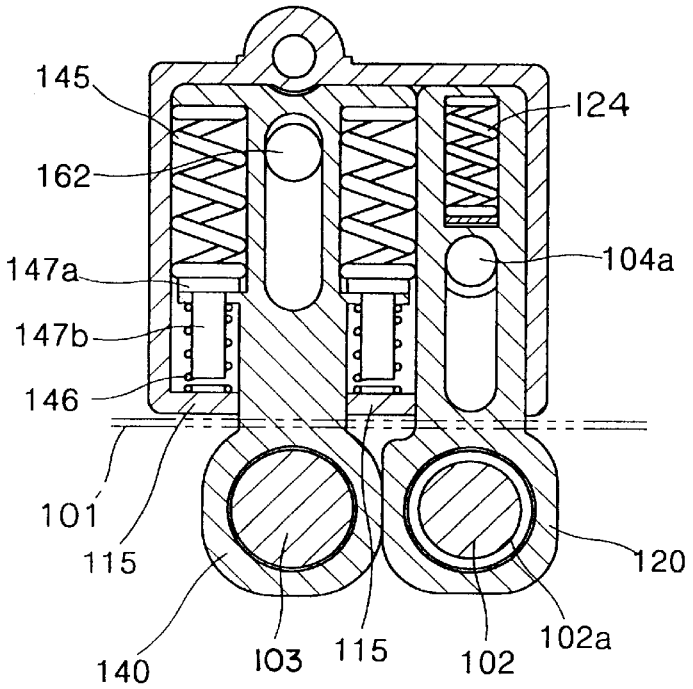

In this case, referring to FIG. 6 showing the states of parts installed in the case 110, the first spring 124, and the second and third springs 145 and 146, are respectively accommodated in the first block 120 and the second block 140, and are kept at non-constricted normal states.

Figure 7:
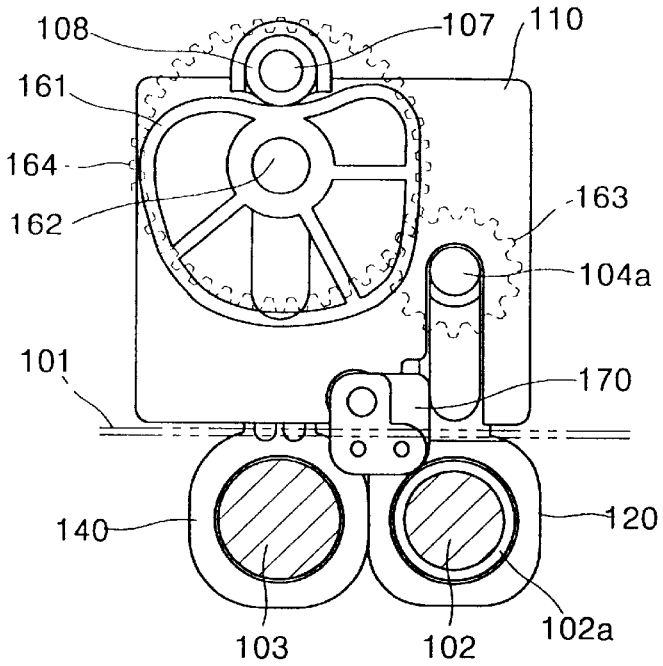
FIGS. 7 through 10 illustrate the operation state of the apparatus for elevating a squeegee roller and a development roller for a liquid printer according to the present invention in a printing mode.

Next, referring to FIG. 7 showing the operation state of the elevating apparatus in a printing mode, the supporting shaft 104*a* of the development backup roller 104 rotates by a driving force supplied from the driver M. As the supporting shaft 104*a* of the development backup roller 104 rotates, the first gear 163 coupled to the end of the supporting shaft 104*a* and the second gear 164 in engagement with the first gear 163 rotate accordingly.

Thus, while the cam member 161 coaxially coupled to the rotation shaft 162 of the second gear 164 rotates, it interferes with the first bearing 108 installed on top of the case 110 to lift the case 110 upward.

Figure 8:
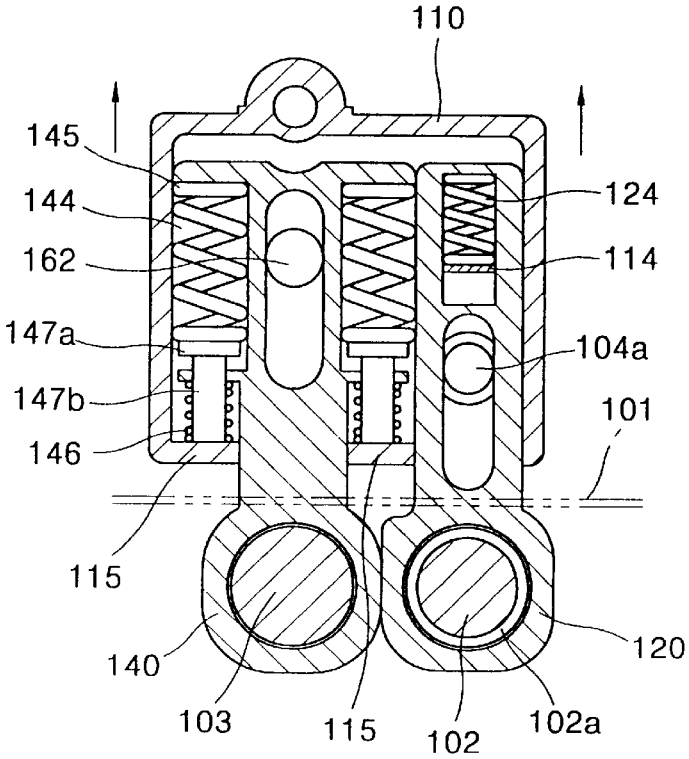

In this case, referring to FIG. 8 showing the operation state of the internal parts of the case 110, as the case 110 ascends by the interference of the cam member 161, the first spring 124, and the second and third springs 145 and 146 respectively accommodated in the first insertion groove 123 of the first block 120 and the second lead-in groove 144 of the second block 140 are constricted, while being placed on the protrusion piece 114 and the protrusion 115 inwardly protruding in the case 110, respectively. As the third spring 146 is constricted, the leg 147*b* of the pin member 147 contacts and presses the bottom of the case 110, and the head 147*a* of the pin member 147 presses the second spring 145.

Figure 9:
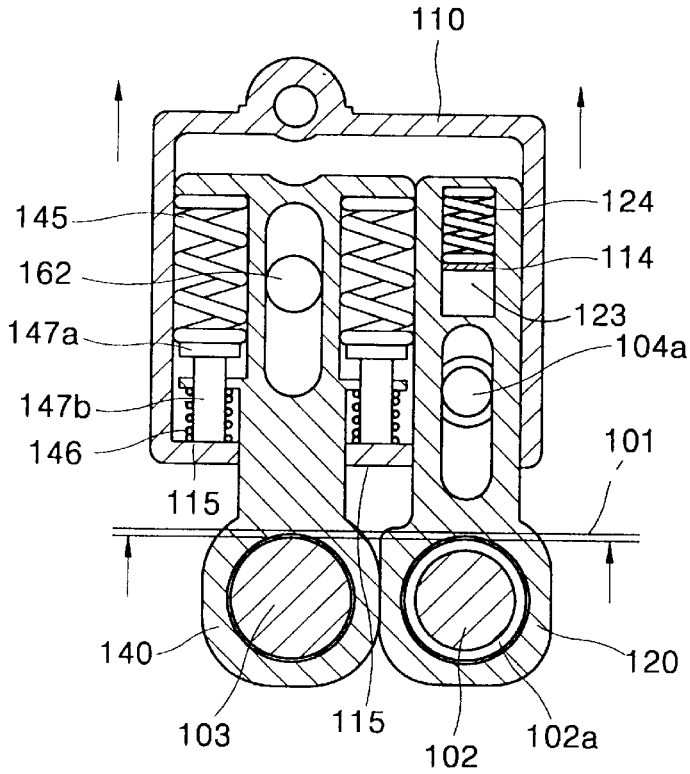

If the case 110 continues to ascend by the operation of the cam member 161, as shown in FIG. 9, the protrusion piece 114 and the head 147*a* of the pin member 147 further presses the first spring 124 and the second spring 145. Here, the first spring 124 is kept at an elastically pressed state between the protrusion piece 114 of the case 110 and the internal top end of the insertion groove 123 of the first block 120. Also, the second spring 145 and the third spring 146 are kept at an elastically pressed state between the protrusion 115 of the case 110 and the first and second lead-in grooves 143 and 144 of the second block 140.

According to the present invention, in the above-described states, the repulsive forces of the first, second and third springs 124, 145 and 146 are set to be high enough to overcome the ascensional power of the case 110. Therefore, in the state where the first, second and third springs 124, 145 and 146 are elastically pressed, the ascensional power of the case 110 is transferred to the first block 120 and the second block 140, and the first block 120 and the second block 140 also ascend. Accordingly, the development roller 102 and the squeegee roller 103 supported on the lower portions of the first block 120 and the second block 140 also ascend to then contact the transfer surface of the photoreceptor belt 101.

Figure 10:
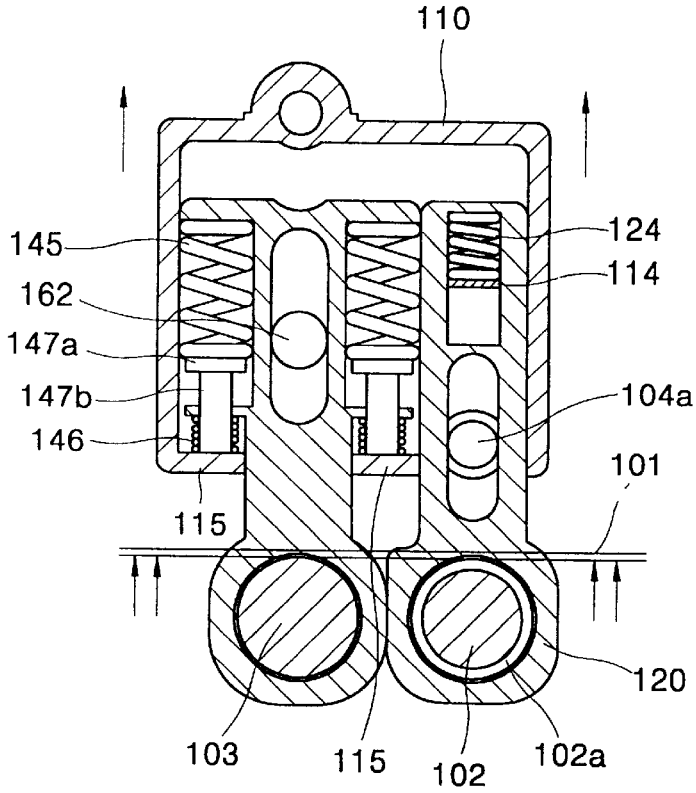

In such a state, as shown in FIG. 10, the case 110 further ascends by the interference of the cam member 161 to reach the ascending limit. In the course of ascending, since the development roller 102 and the squeegee roller 103 are constrained by the photoreceptor belt 101, the ascending of the first block 120 and the second block 140 is interrupted. Therefore, only the case 110 further ascends to elastically press the first, second and third springs 124, 145 and 146. Accordingly, the ascensional power of the case 110 is transferred to the first block 120 and the second block 140 so that the development roller 102 and the squeegee roller 103 supported on the lower portions thereof tend to further ascend toward the photoreceptor belt 101, thereby further pressing the photoreceptor belt 101 upward.

In this embodiment, the squeegee roller 103 ascends about 12 mm from its position for a pausing mode and presses the photoreceptor belt 101 with a compressive force of about 20 kgf. When the gap ring 102*a* coupled to a shaft end of the development roller 102 contacts the backup roller 104, the development roller 102 ascends to a position at which only a small gap is maintained between the development roller 102 and the photoreceptor belt 101 in a printing mode.

In the apparatus for elevating a development roller and a squeegee roller according to the present invention, the compressive force of the squeegee roller 103 against the photoreceptor belt 101 may vary by setting various dimensions of elastic forces of the second and third springs 145 and 146 in accordance with the printer model or size.

Also, although the curved portion of the cam member 161 has been schematically shown in the drawings, it can be modified or varied so that the elevation distance of the case 110 can be determined in accordance with the printer model or size. Therefore, the elevation position of the development roller 102 can be adjusted and the elevation stroke of the squeegee roller 103 can be adjusted, thereby applying various kinds of compressive forces to the photoreceptor belt 101.

Figure 11:
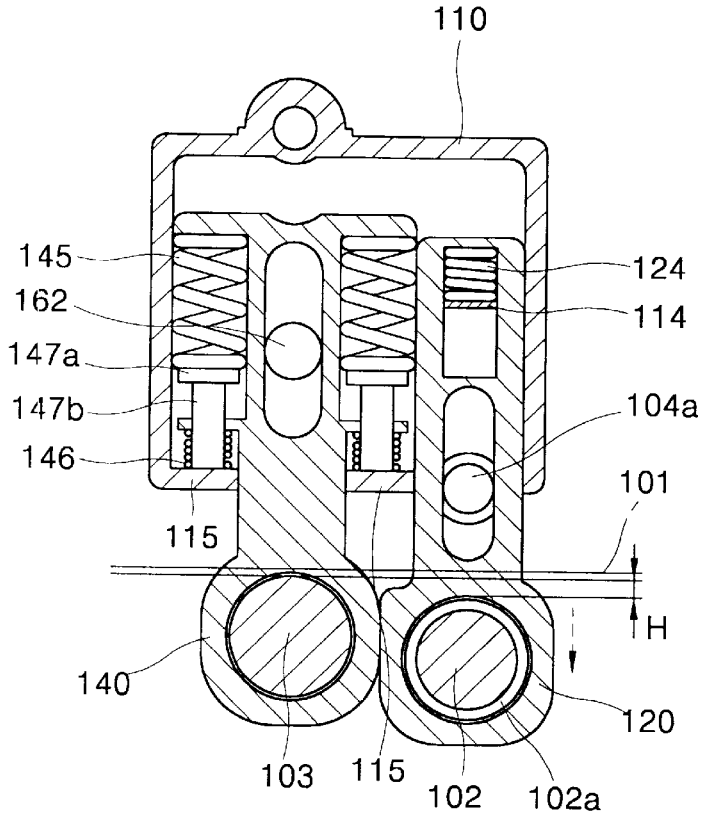
FIGS. 11 and 12 illustrate the operation state of the apparatus for elevating a squeegee roller and a development roller for a liquid printer according to the present invention in a drip line removal mode.
Figure 12:
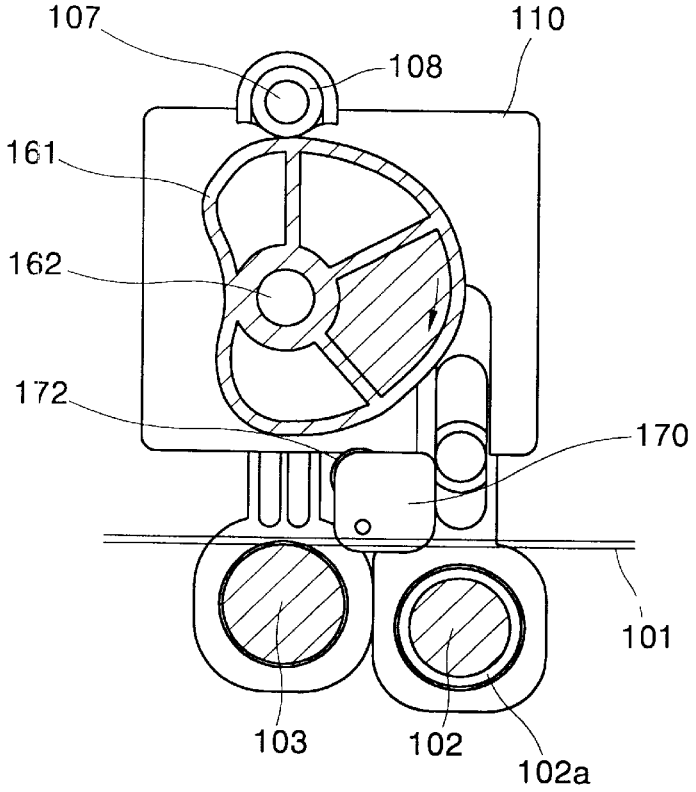

FIGS. 11 and 12 show the operation states of the elevating apparatus according to the present invention in a drip line removal mode. Referring to the drawings, if the cam member 161 rotates, the curved portion thereof moves to contact the first bearing 108 to then change the contact portion therebetween, so that the case 110 slightly descends from the position at which it reaches the ascending limit. Accordingly, the development roller 102 and the squeegee roller 103 slightly descend, so that the compressive force applied to the photoreceptor belt 101 is slightly lower than that in the printing mode.

Then, the curved portion of the cam member 161 constrains the second bearing 172 installed in the cam protrusion 170 of the first block 120 to lower the first block 120. Accordingly, the development roller 102 supported on the first block 120 descends so as to be further spaced apart a predetermined distance (H) from the photoreceptor belt 101, compared to the case in the printing mode.

In this embodiment, the compressive force of the squeegee roller 103 against the photoreceptor belt 101 is about 2 kgf, and the development roller 102 is further spaced apart a predetermined distance (H), i.e., at least 4 mm, from the photoreceptor belt 101, compared to the case in the printing mode.

In the present invention, in accordance with the printer mode or size, the shape of the curved portion of the cam member 161 and the dimensions of the cam protrusion 170 and the second bearing 172 can be changed in various manners, thereby adjusting the elevation positions of the squeegee roller 103 and the development roller 102. In such a manner, the compressive force of the squeegee roller 103 against the photoreceptor belt 102 and the distance between the development roller 102 and the photoreceptor belt 102 can be adjusted.

As described above, if the development roller 102 is spaced apart from the photoreceptor belt 102, the squeegee roller 103, which passively rotates in the traveling direction of the photoreceptor belt 101 in the printing mode, rotates in a reverse direction to the traveling direction of the photoreceptor belt 101 in the drip line removal mode, so that the squeegee roller 103 squeegees excess ink remaining on the transfer surface of the photoreceptor belt 101 and drops the same to remove the drip line.

The reverse rotation of the squeegee roller 103 may be done by using a separate power source or a driving force produced by connecting an electronic clutch, for example, to the driver M connected to the supporting shaft 104*a* of the development backup roller 104.

As described above, in the apparatus for elevating a development roller and a squeegee roller for a liquid printer according to the present invention, the squeegee roller and the development roller are adaptively elevated according to the operation mode of the printer such that the development roller is elevated in sequence by using a cam mechanism for elevating the squeegee roller, instead of separately driving the squeegee roller and the development roller. Therefore, the overall printer system can be made compact.

What is claimed is:

1. An apparatus for elevating a squeegee roller and a development roller for a liquid printer, comprising:

a pair of first supporting blocks which rotatably support both ends of the development roller that transfers a developer liquid to a transfer surface of a photoreceptor belt;

a pair of second supporting blocks which rotatably support both ends of the squeegee roller that compresses the transfer surface of the photoreceptor belt and removes liquid carrier contained in transferred developer liquid;

a pair of cases, wherein one of the first supporting blocks and one of the second supporting blocks are elevatably accommodated parallel to each other in one of the cases, and wherein an other of the first supporting blocks and an other of the second supporting blocks are elevatably accommodated parallel to each other in an other of the cases;

a first elevating means for elevating the cases relative to the photoreceptor belt;

a driver unit for driving the first elevating means; and a second elevating means for elevating the first and second supporting blocks in sequence with the elevation of the cases.

2. The elevating apparatus according to claim 1, wherein the driver unit includes a driving source for driving a rotation supporting shaft rotatably coupled to a central; axis cavity of a development backup roller installed to correspond to the development roller with the photoreceptor belt interposed therebetween, and a rotation shaft whose one end is coupled to a housing of the printer so that a first gear installed at one end of the rotation supporting shaft of the development backup roller and a second gear in engagement with the first gear are rotatably coupled to each other.

3. The elevating apparatus according to claim 2, wherein the first elevating means includes a cam member rotatably coupled to the rotation shaft in parallel with the second gear, and a first cam follower member installed in the cases to perform cam driving along a curved surface of the cam member when the cam member rotates.

4. The elevating apparatus according to claim 3, wherein the first cam follower member includes a supporting shaft installed in an upper portion of the cases such that its one end protrudes, and a rotation member rotatably installed on the protruding end of the supporting shaft.

5. The elevating apparatus according to claim 4, wherein the rotation member is a bearing member.

6. The elevating apparatus according to claim 3, wherein the second elevating means includes one or more elastic bodies interposed to be elastically biased between a corresponding one of the cases and a corresponding one of the first supporting blocks and between the corresponding case and a corresponding one of the second supporting blocks, and a second cam follower member installed in the corresponding first supporting block to be interfered with by the cam member.

7. The elevating apparatus according to claim 6, wherein the elastic bodies are mounted on a plurality of protrusion pieces protruding inside the corresponding case and are installed such that top ends of the elastic bodies are constrained by top ends of insertion grooves respectively provided in the corresponding first and second supporting blocks.

8. The elevating apparatus according to claim 7, wherein the corresponding first supporting block has throughholes to which one end of the development roller is rotatably coupled, in its lower portion; a slot through which the rotation supporting shaft of the development backup roller installed to correspond to the development roller with the photoreceptor belt disposed therebetween penetrates, is provided above the throughholes; and an insert groove, into which a corresponding one of the protrusion pieces protruding inside the corresponding case and the elastic bodies mounted on the protrusion piece are both inserted, is provided above the slot.

9. The elevating apparatus according to claim 8, wherein when the corresponding case and the corresponding first and second supporting blocks are combined, lower portions of the corresponding first and second supporting blocks in which throughholes are provided are exposed at a bottom of the corresponding case, and upper portions thereof in which slots are provided are covered by the corresponding case.

10. The elevating apparatus according to claim 6, wherein the second cam follower member includes a protrusion installed on the corresponding first supporting block to protrude outside the corresponding case, a supporting shaft installed in the protrusion such that its one end protrudes, and a rotation member rotatably installed on the protruding end of the supporting shaft.

11.The elevating apparatus according to claim 10, wherein the rotation member is a bearing member.

12. The elevating apparatus according to claim 1, wherein a corresponding one of the second supporting blocks has throughholes to which one end of the squeegee roller is rotatably coupled, in its lower portion; a slot through which a rotation supporting shaft of a squeegee backup roller installed to correspond to the squeegee roller, with the photoreceptor belt disposed penetrating therebetween, is provided above the throughholes; first and second lead-in grooves are provided parallel to each other in the vicinity of the slot with a hooking lock disposed therebetween; a pair of pin members disposed at opposite sides of the slot parallel to each other, with their heads locked on the hooking lock and their legs are accommodated in the second lead-in groove; springs are mounted on the heads to then be elastically biased to the first lead-in groove; and further springs are disposed on protrusion pieces protruding inside the corresponding case to then be elastically biased such that their heads are locked by the hooking lock, with the legs accommodated in the second lead-in groove.

13. The elevating apparatus according to claim 12, wherein when the corresponding case and the corresponding first and second supporting blocks are combined, lower portions of the corresponding first and second supporting blocks in which throughholes are provided are exposed at a bottom of the corresponding case, and upper portions thereof in which slots are provided are covered by the corresponding case.

* * * * *